US005769142A

United States Patent [19]

Nicolosi

[11] Patent Number: 5,769,142

[45] Date of Patent: Jun. 23, 1998

[54] DEVICE FOR OPERATING VENETIAN BLINDS BY MAGNETIC MECHANISM

[75] Inventor: Giovanni Nicolosi, Codogno, Italy

[73] Assignee: Pellini S.R.L., Milan, Italy

[21] Appl. No.: 682,530

[22] PCT Filed: Jul. 22, 1994

[86] PCT No.: PCT/IT94/00121

§ 371 Date: Jul. 23, 1996

§ 102(e) Date: Jul. 23, 1996

[87] PCT Pub. No.: WO95/24539

PCT Pub. Date: Sep. 14, 1995

[30] Foreign Application Priority Data

Mar. 11, 1994 [IT] Italy ..... MI94A0460

[51] Int. Cl.[6] ..... E06B 3/32

[52] U.S. Cl. ..... 160/107; 160/176.1 R; 49/64

[58] Field of Search ..... 160/107, 176.1 R, 160/177 R, 176.1 P, 98; 49/64

[56] References Cited

U.S. PATENT DOCUMENTS

| | | | |
|---|---|---|---|
| 3,129,471 | 4/1964 | Johnson et al. | 160/107 X |
| 3,153,819 | 10/1964 | Bond | 160/107 X |
| 3,201,832 | 8/1965 | Hordis et al. | 49/64 |
| 3,253,644 | 5/1966 | Gotoh et al. | 160/107 |
| 3,722,572 | 3/1973 | Hall | 49/64 X |
| 4,588,012 | 5/1986 | Anderson | 160/107 X |
| 4,723,586 | 2/1988 | Spangenberg | 160/107 |
| 4,817,698 | 4/1989 | Rossini et al. | 160/107 |
| 5,396,944 | 3/1995 | Rossini | 160/107 |

*Primary Examiner*—David M. Purol
*Attorney, Agent, or Firm*—Michael J. Striker

[57] ABSTRACT

A device for operating venetian blinds inside a sealed chamber between two panes of glass has a gearing-down internal mechanism provided for rotating a shaft that supports and operates a blind, and a gearing-up external mechanism applied to one of the glass panes and connected with the gearing-down internal mechanism by a magnetic connection.

12 Claims, 4 Drawing Sheets

DEVICE FOR OPERATING VENETIAN BLINDS BY MAGNETIC MECHANISM

BACKGROUND OF THE INVENTION

The invention concerns devices for operating blinds. Problems of heat insulation in buildings is becoming of increasing importance particularly because of the rising cost of the types of energy utilizable for heating. Efficient insulation in any case enables a big reduction to be made in the quantity of energy needed to maintain a comfortable temperature inside the home.

One of the greatest causes of heat loss in a house is represented by its window area. Heat dispersed through windows mainly depends on losses by convection, when air from outside mixes with inside air through badly fitting window frames, and on losses by conduction when air inside is cooled against glass chilled by low outdoor temperatures. Heat insulation can be substantially improved by installation of double glazing when, because of the air-filled cavity between the two panes, heat loss is greatly lessened. An even more noticeable improvement is obtained by changing from single glazing to double glazing with a vacuum in between.

The presence of blinds, called venetian, greatly complicates the problem as, for reasons of bulk and for a number of advantages, such as there being no need for maintenance, protection against dust and grease and against possible accidental damage, it is preferable to place the blind inside the cavity formed between two panes of glass. This type of blind can in fact be worked by devices outside the blind and operated inside the room.

To assure mechanical connection between the blind and the operating devices, the connecting parts must enter the sealed chamber formed between the panes of glass.

To keep the cavity sealed elastic packing has to be used in order to permit hermetic closure independently of any movements made by connecting mechanisms.

Over a period of time this packing wears out and air from outside penetrates inside the cavity greatly lessening the advantages associated with double glazing. The above invention avoids these drawbacks as will be explained below.

SUMMARY OF THE INVENTION

Subject of the invention is a device for working venetian blinds within a sealed chamber comprising two panes of glass, an intermediate frame to support said panes, a horizontal shaft to carry and work the blind inside the sealed chamber formed between the panes and a mechanism for rotating said shaft.

The mechanism, now to be referred to as internal, for rotating the shaft, is connected to another mechanism, now to be referred to as external, for working the parts outside the sealed chamber by means of a magnetic connection whose lines of force act through one of the glass panes. The magnetic connection consists of a disc carrying permanent magnets fixed to one end of a shaft forming part of the internal mechanism for rotating the shaft to work the blind, placed a short distance away from the inner face of one pane of glass.

Said disc is opposite to a disc carrying permanent magnets fixed to one end of a shaft forming part of the external mechanism and placed at a short distance from the outer face of said pane of glass.

The two shafts, respectively part of the external and internal mechanisms, are coaxial.

The permanent magnets on the discs in the internal and external mechanisms have different polarities in relation to a diameter.

In the middle of each of said discs in the internal and external mechanisms is a pin with a rounded end and the two pins make contact with the opposite surfaces of the glass reacting against reciprocal magnetic attraction.

The internal mechanism preferably comprises a gearing-down unit formed of a rotor which, by means of pins parallel to its axis and placed at equal radial and angular distances, carries equal satellite pinions that simultaneously mesh with a crown gear fixed coaxially to the rotor, included in the body of said mechanism, and with circumferential toothing on a small coaxial shaft.

The rotation impressed on said small shaft is therefore transmitted to the rotor at a divisor ratio corresponding to that between the teeth on the small shaft and on the crown gear respectively.

Said rotor is connected to the shaft working the blind and therefore transmits the geared-down movement to said latter shaft.

The external mechanism comprises a gearing-up unit consisting of a rotor which, by means of pins parallel to its axis and placed at equal radial and angular distances, carries satellite pinions that mesh simultaneously with a fixed crown gear, coaxial to the rotor, in the body of said mechanism, and with circumferential toothing on the coaxial shaft of the rotor to which the disc with permanent magnets is fixed.

The rotation impressed upon the rotor is therefore transmitted to said shaft at a gearing-up ratio corresponding to the ratio between the teeth of the fixed crown gear and of the shaft, respectively.

The rotor is connected to a means for working the blind so that, when transmitted, the action of said operating means has been geared up.

The operating means for the blind is a continuous cord one end of which passes round a pulley fixed to and coaxial with the rotor, or said means is an electric motor or else it is a rod attached at the top by a joint to a small vertical shaft.

Said small shaft is connected by a bevel gear pair to the shaft onto which is fixed the disc carrying permanent magnets forming part of the external mechanism.

The shaft in the internal mechanism, with its disc carrying permanent magnets, transmits its action to the shaft working the blind through a pair of shaft transmissions at 90° consisting of a worm screw fixed to the first shaft and a worm gear fixed to the small shaft forming part of the gearing-down unit.

The internal mechanism is placed inside a substantially flat body forming one of the four corner elements which, together with four tubular bars, form the intermediate frame supporting the two panes of glass. Thickness of said body is substantially equal to the width between said bars.

Connection between said bars and said corner elements is made by means of tabs at 90° that project at the two ends of each corner element.

The shape and size of said tabs correspond to those of the tubular bars so that said tabs can be pressed into the ends of the bars.

The frame so constructed is of constant thickness to permit formation of the sealed chamber between the two panes of glass, one on each side of the frame.

Structure is stable and is sealed by glue and the like.

The face of the body of the external mechanism fits up against the glass, said face being substantially flat and parallel to the disc carrying the permanent magnets so as to permit association to said glass by a sheet of double-sided adhesive material or some other glueing means. The invention possesses evident advantages.

As the blind is worked from outside the sealed cavity between the panes by a magnetic connection through one of the panes and without either the frame or the glass having to be perforated to allow passage of mechanisms, the problem of obtaining a sealed cavity is practically solved.

The original form of construction with inner and outer discs carrying permanent magnets of double polarity in relation to a diameter and with coaxial shafts, means reduced bulk, constructional simplicity and, at the same time, high power of transmission.

The central rounded pins on the magnetic discs ensure maximum reciprocal force of attraction while allowing complete liberty of movement and therefore the highest possible efficiency of the magnetic connection.

The ratio of transmission, geared-up upstream of the magnetic connection and geared-down downstream of said connection, prevents slippage among components of the connection while the blind is being worked.

But if a previously established mechanical torque is exceeded, the magnets permit a clutch-type slippage that prevents any damage being done to the mechanisms.

The cavity between panes with its frame of tubular bars and corner elements of equal thickness, with an internal mechanisms inside a corner element and an external mechanism simply mounted on one of the glass panes, provides a simple and rational structure, inexpensive but extremely practical in use.

Characteristics and purposes of the invention will be made still clearer by the following examples of its execution illustrated by diagrammatically drawn figures.

DESCRIPTION OF PREFERRED EMBODIMENTS

Figure 2:
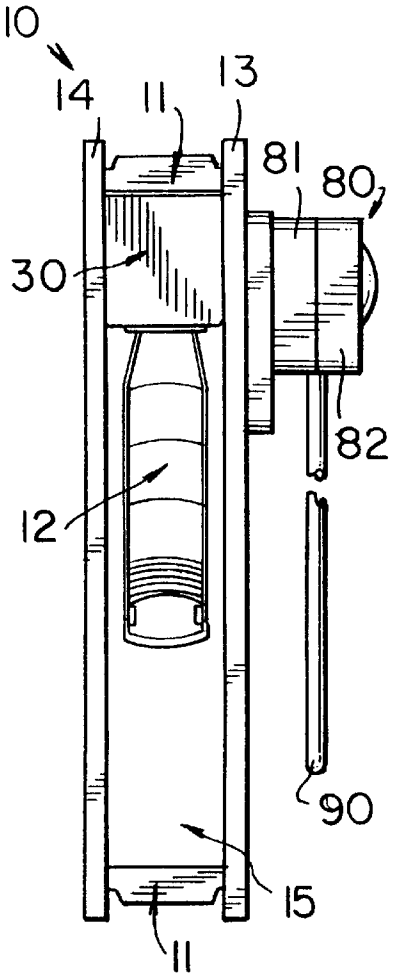
FIG. 2 The same as FIG. 1 but seen from the side.
Figure 1:
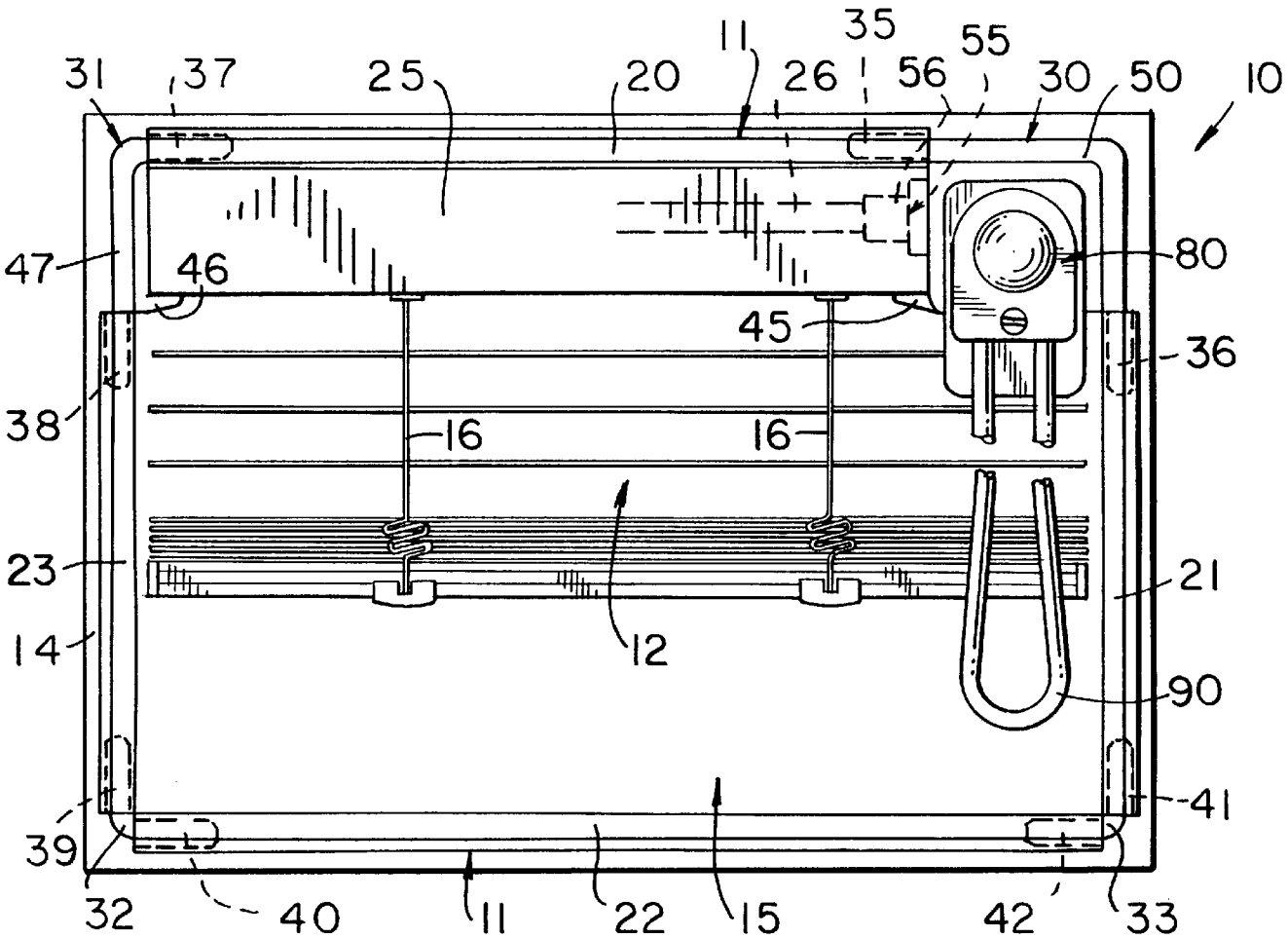
FIG. 1 Venetian blind enclosed in a chamber between two panes of glass, operated by a cord, front view.

The venetian blind within sealed chamber between two panes of glass 10 comprises a frame 11 formed of aluminium parts 20–23 of a substantially rectangular cross section, connected at the four corners by specially made elements. The main element 30 at the top on the right is box-shaped and comprises the mechanism for rotation of the shaft 26 that supports and operates the slatted blind 12.

The tabs 35 and 36 project at 90° at the upper left and lower right hand corners and can be pushed inside the aluminium bars 20 and 21 with a moderate amount of effort. At the lower left hand corner is a tooth 45 and this, with the tab 35 creates a seat for one end of the box-shaped head 25 of the blind 12.

At the upper left hand corner of the frame 11 is a connecting part 31 comprising an oblong body 47.

At the upper end of said body is a tab 37 at 90° and at the lower end an aligned tab 38.

Said tabs are similar to the tabs 35 and 36 already described and can be fitted into the rectangular bars 20,23. Close to said tab 38 is a tooth 46 projecting orthogonally to the body 47, said tooth being opposed to the tooth 45 on the main element 30 forming, with the tab 37, a seat for the other end of the box-shaped head 25.

At the lower end of the frame the corner pieces 32,33, with pairs of tabs 39,40 and 41,42 similar to tabs 35–38 already described, make possible association of the fourth bar 22 to complete the frame 11.

To this frame the glass panes 13, 14 are applied,with adhesives or adhesive strips,forming the sealed chamber 15 that contains within it the slatted blind 12 and the box in which it is stowed with the shaft 26, ties 16 and whatever else is needed to work it.

Figure 3:
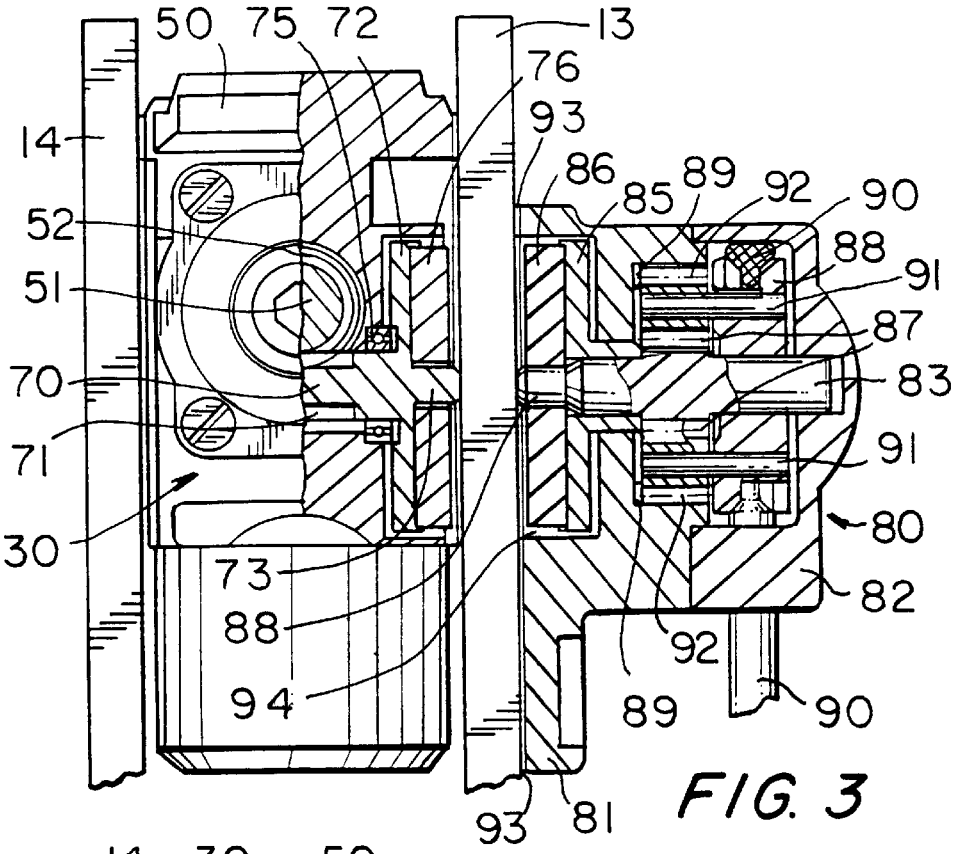
FIG. 3 Detail of the mechanism, axial section.
Figure 4:
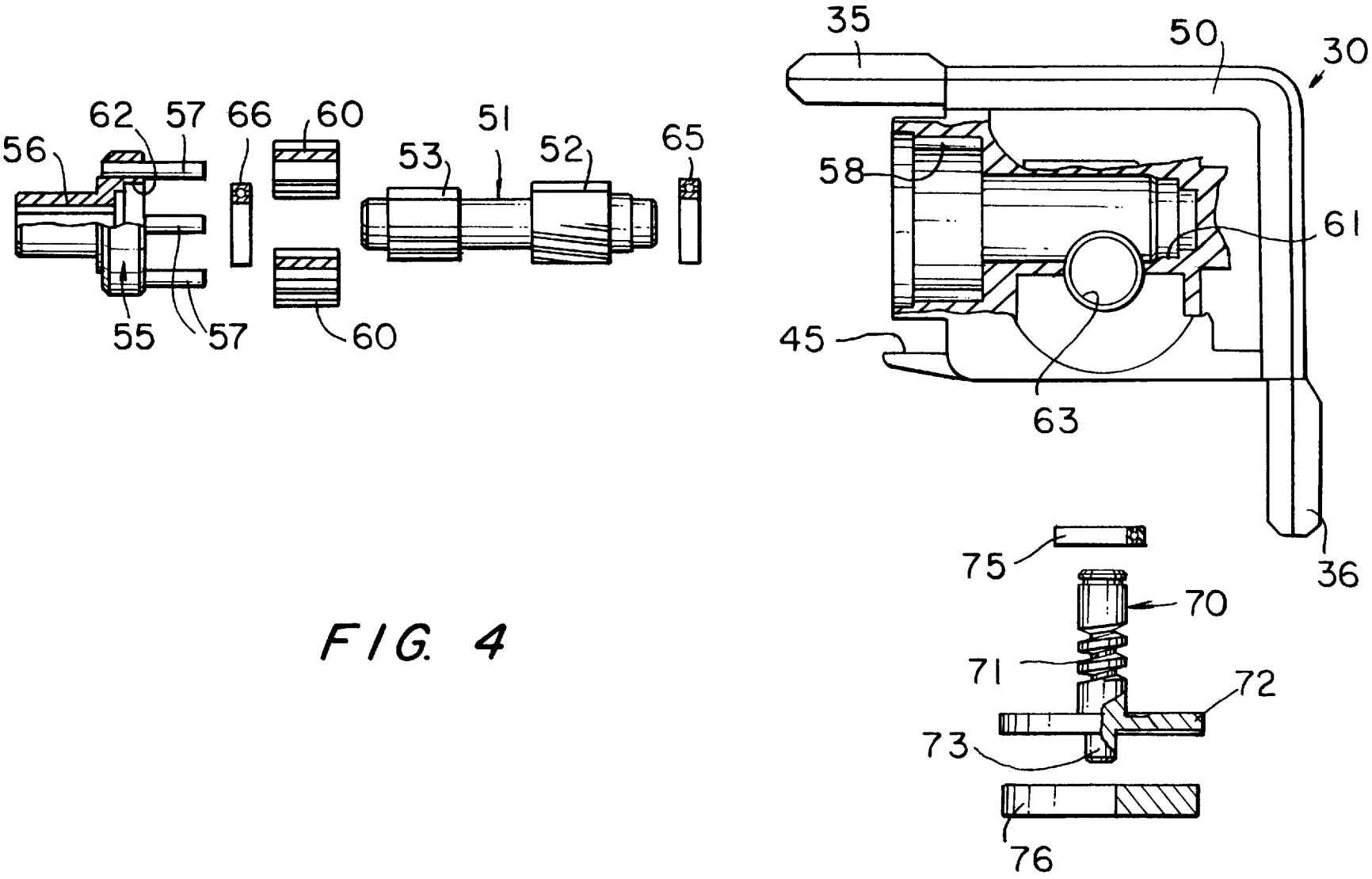
FIG. 4 Exploded view showing details of the internal mechanism inside the above chamber.

The main element 30 comprises the body 50 and the mechanism shown in FIGS. 3 and 4.

This mechanism is essentially formed of a small shaft 51 on which are mounted the gears 52,53 of the rotor 55 with coupling 56 and four pins 57 parallel to the axis, set at equal radial and angular distances in relation to said axis. On said pins four equal pinions 60 turn freely that mesh simultaneously with the gear 53 and the crown gear 58 inside said body 50.

After mounting, the bearings 65, 66 respectively settle into the seats 61, 62 of the body 50 and rotor 55 respectively, creating the support for the small shaft 51 which can then turn freely on said bearings.

This mechanism also comprises the shaft 70 which in turn comprises a worm screw 71 and discord plate 72 with rounded pin 73. After mounting, the bearing 75 settles into the seat 63 25 in the body 50 forming a support for the shaft 70. The worm screw 71 meshes orthogonally with the gear 52. On the discoid plate 72 is mounted the permanent discoid magnet 76 of double polarity in relation to a diameter. When the glass panes 13 and 14 are glued on, the rounded pin 73 makes contact with the glass pane 13 (FIG.3). Clearly, therefore, causing the magnet 76 to rotate and so too the discord plate 72, by means of the screw 71 the shaft 51 is caused to rotate geared down to match the number of teeth on the gear 52.

Said shaft in turn determines rotation of the axial rotor 55 with further gearing-down in the ratio between the number of teeth of the gear 53 and of the crown gear 58, respectively, on the body 50.

Since the whole element 30 including its mechanism remains 'enclosed' inside the sealed chamber 15, rotation of the magnet 76 is determined through the glass 13 by means of the device 80.

Said device 80 comprises the body 81 with cap 82 that permits free rotation of the shaft 83.

On the front of said shaft is fitted the discoid plate 85 and, in the centre, the gear 87. At the rear, on this shaft, pulley 88 turns freely pulled by the continuous cord 90. Said pulley supports four pins 91 at equal radial and angular distances from the axis of the shaft 83 on which can freely turn four equal pinions 92 contemporaneously meshing with the gear 87 and with the crown gear 89 inside the body 81.

The permanent discoid magnet 86, of double polarity in relation to a diameter, is placed on the plate 85, said magnet being substantially the same as the magnet 76.

The body 81 is firmly held to the glass pane 13 by the double-adhesive band 93 around the seat 94 in said body 81 in which the plate 85 is lodged so that the magnet 86 is placed opposite to the magnet 76 on the plate 72, regulation being determined by contact of the rounded pin 88 on the shaft 83, and of the rounded pin 73 on the shaft 70, on the two sides of the pane of glass 13.

It is thus clear that by pulling the cord 90 the magnet 86 will rotate geared-up in accordance with the ratio between the number of teeth on the crown gear 89 and those on the gear 87.

Through the glass pane 13, said magnet 86, rotating, pulls along the magnet 76 and therefore the plate 72, and, through the mechanism in the element 30, the coupling 56 as well. As the shaft 26, supporting and working the slatted blind, is fixed to said coupling 56, by pulling the cord 90 the blind inside the sealed chamber 15 is operated through the glass pane 13.

Gearing-up, determined by the device 80, makes rapid operation possible by means of the cord.

At the same time gearing-down, determined by the mechanism in element 30, permits the magnet 76 to be drawn along by the magnet 86 without risk of creating a torque reaction greater than the reciprocal force of attraction of said magnets.

In place of the cord an electric motor can of course be fitted, with or without remote control.

Figure 7:
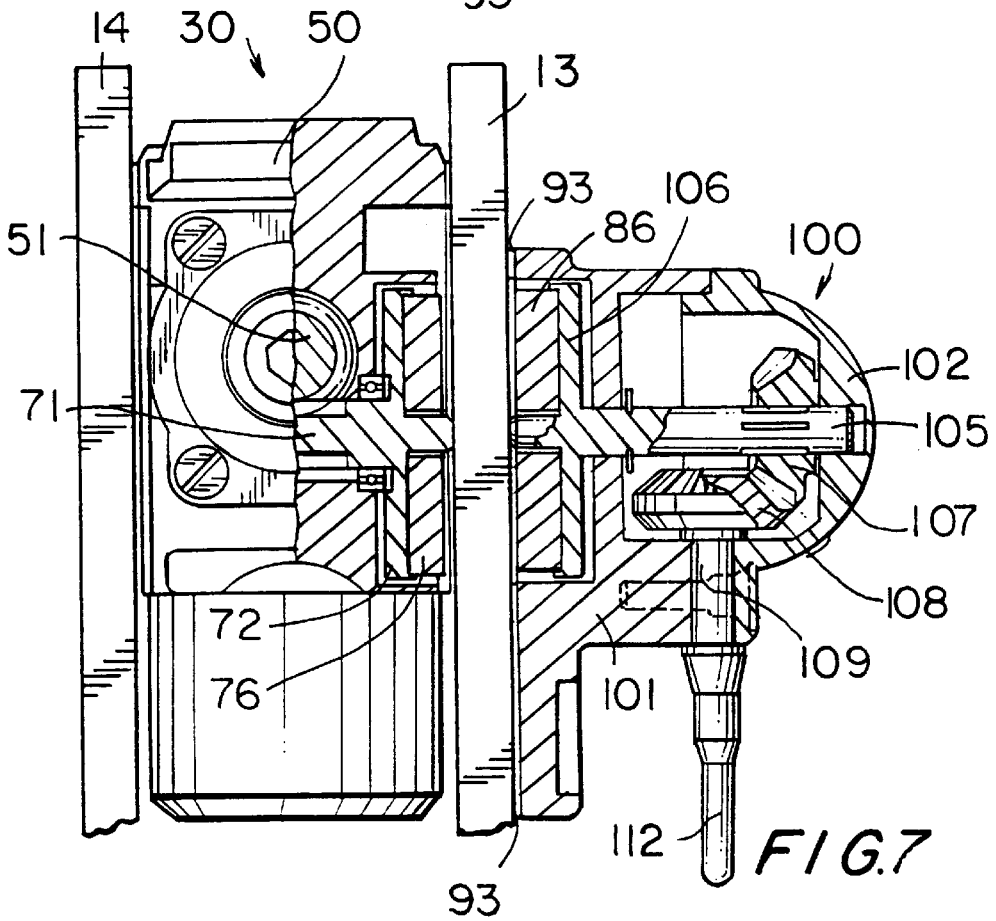
FIG. 7 Detail of the mechanism operated by a rod, axial section.
Figure 6:
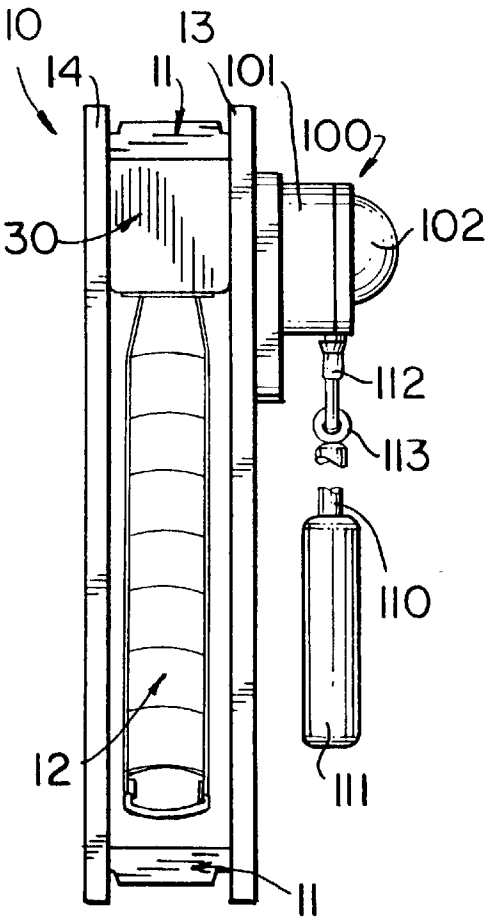
FIG. 6 The same as FIG. 5 seen from the side.
Figure 5:
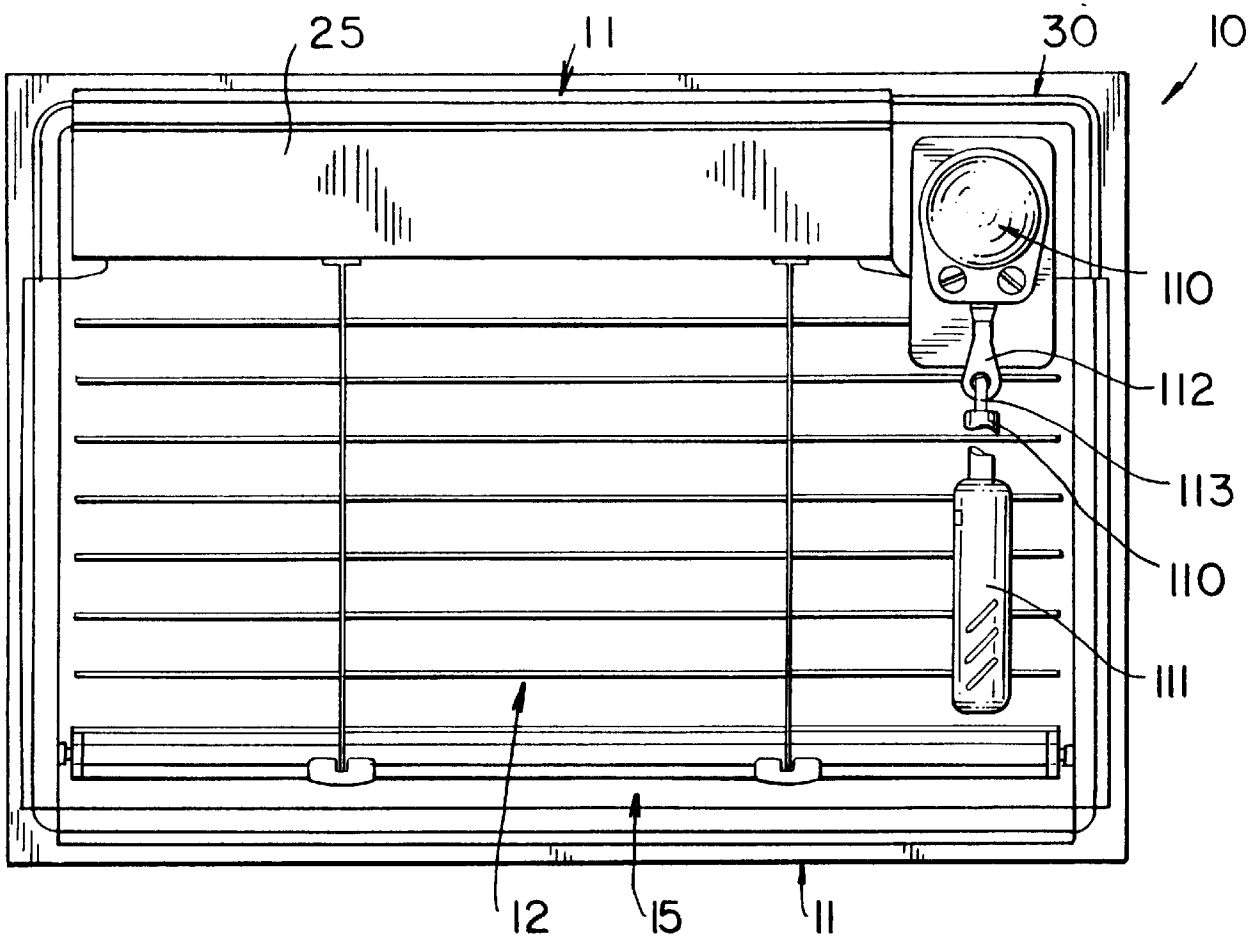
FIG. 5 Front view of the blind operated by a rod.

Alternatively a rod 110 can be used as shown in FIGS. 5–7. The device 80 already described is replaced by another device 100 that comprises a body 101 and cap 102 freely supporting the shaft 105 with front plate 106.

Said shaft carries the bevel gear 107 that pairs with the gear 108 fixed to the pin 109.

The magnet 86 is mounted on said plate 106.

The pin 109 is fixed to the operating rod 110 with a handle 111 by means of the eyelets 112 and 113.

As speed of rotation conferred manually on the rod is generally lower than that which can be conferred by the cord 90 or by an electric motor, and as there is no gearing-up between the pin 109 and the shaft 105, the mechanism described in FIG. 4 is modified and the coupling 56 is substantially fixed to the shaft 51.

I claim:

1. A pane device with venetian blinds, comprising two panes of glass forming a sealed chamber; a blind arranged within said sealed chamber; a horizontal shaft for supporting and operating said blind; an internal mechanism provided for rotating said shaft; and an external mechanism operating outside said sealed chamber, said mechanisms having magnetic connection means with lines of forces passing through one of said panes of glass, said internal mechanism has a body and a gearing-down unit including a rotor placed in said body and carrying satellite pinions meshing with a fixed crown gear coaxial with said rotor and with circumferential teeth of a coaxial shaft, so that a rotation impressed on said coaxial shaft is transmitted to said rotor at a divisor ratio corresponding to a ratio between said teeth of said shaft and said crown gear, said rotor being connected with said horizontal shaft for supporting and operating said blind.

2. A pane as defined in claim 1; and further comprising an intermediate frame for supporting said panes.

3. A pane as defined in claim 1, wherein said magnetic connection means include a first shaft of said internal mechanism provided with a disk with permanent magnets located at a distance from an inner face of said one pane; and a second shaft of said external mechanism provided with a second disk with permanent magnets located at a distance from an outer face of said one glass, said shafts being coaxial with one another.

4. A pane as defined in claim 3, wherein said permanent magnets of said first shaft and said permanent magnets of said second shaft have different polarities.

5. A pane as defined in claim 3, wherein said disks have centers and are provided in said centers with rounded pins which make contact with a surface of said one pane.

6. A pane as defined in claim 3; and further comprising transmission means for transmitting a movement from said first shaft of said internal mechanism to said horizontal shaft which supports and operates said blind, said transmission means being formed to transmit a movement at 90° and including a worm screw fixed to said first shaft and a worm gear fixed to said horizontal shaft.

7. A pane as defined in claim 3, wherein said external mechanism has a body with a face matchable with said one pane, said face being substantially flat and parallel to said first disk mounted on said first shaft.

8. A pane device with venetian blinds, comprising two panes of glass forming a sealed chamber; a blind arranged within said sealed chamber; a horizontal shaft for supporting and operating said blind; an internal mechanism provided for rotating said shaft; and an external mechanism operating outside said sealed chamber, said mechanisms having magnetic connection means with lines of forces passing through one of said panes of glass, said magnetic connection means including a first shaft of said internal mechanism provided with a first disk with permanent magnets located at a distance from an inner face of said one pane; and a second shaft of said external mechanism provided with a second disk with permanent magnets located at a distance from an outer face of said one glass, said shafts being coaxial with one another, said external mechanism having a body and a gearing-up unit including a rotor placed in said body and carrying satellite pinions meshing with a fixed crow gear coaxial with said rotor and with circumferential teeth of said second shaft, so that a rotation impressed on said rotor is transmitted to said second shaft at a geared-up ratio corresponding to a ratio between said teeth of said crown gear and said second shaft; and further comprising means for operating said blind and connected with said rotor.

9. A pane as defined in claim 8, wherein said means for operating said blind includes a continuous cord with one end passing around a pulley formed in said body of said rotor of said external mechanism.

10. A pane device with venetian blinds, comprising two panes of glass forming a sealed chamber; a blind arranged within said sealed chamber; a horizontal shaft for supporting and operating said blind; an internal mechanism provided for rotating said shaft; and an external mechanism operating outside said sealed chamber, said mechanisms having magnetic connection means with lines of forces passing through one of said panes of glass, said magnetic connection means including a first shaft of said internal mechanism provided with a first disk with permanent magnets located at a distance from an inner face of said one pane; and a second shaft of said external mechanism provided with a second disk with permanent magnets located at a distance from an outer face of said one glass, said shafts being coaxial with one another, said external mechanism having a body, a vertical shaft supported by said body and a bevel gear pair connecting said vertical shaft with said second shaft; and further comprising means for operating said blind and including a rod fixed at a top by a joint to said vertical shaft.

11. A pane device with venetian blinds, comprising two panes of glass forming a sealed chamber; a blind arranged within said sealed chamber; a horizontal shaft for supporting and operating said blind; an internal mechanism provided for rotating said shaft; and an external mechanism operating outside said sealed chamber, said mechanisms having magnetic connection means with lines of forces passing through one of said panes of glass; an intermediate frame for supporting said panes; and a substantially flat body forming one of four corner elements which together with four tubular bars form said intermediate frame, said internal mechanism being located inside said substantially flat body, said body having a thickness which is substantially equal to a width of the other three corner elements and to a width of said tubular bars.

12. A pane as defined in claim 11; and further comprising means for connecting said bars and said corner elements, said connecting means including pairs of tabs at 90° projecting at two ends of each of said corner elements, said tabs having a shape and a size corresponding to internal dimensions of said bar, so that said frame can be put together by fitting said tabs into ends of said bars, said frame having a thickness selected so as to be constant and to permit creation of said chamber between said two panes of glass, said two panes of glass being placed one on each side of said frame.

* * * * *